United States Patent [19]

Lingott

[11] Patent Number: 4,948,284

[45] Date of Patent: Aug. 14, 1990

[54] WRITING INSTRUMENT WITH SYSTEM FOR SELECTING LOTTO NUMBERS

[76] Inventor: Horst Lingott, Wilhelm Haspel Str. 59/1, D-7032 Sindelfingen, Fed. Rep. of Germany

[21] Appl. No.: 187,518

[22] PCT Filed: Aug. 14, 1987

[86] PCT No.: PCT/DE87/00363

§ 371 Date: Apr. 15, 1988

§ 102(e) Date: Apr. 15, 1988

[87] PCT Pub. No.: WO88/01237

PCT Pub. Date: Feb. 25, 1988

[30] Foreign Application Priority Data

Aug. 16, 1986 [DE] Fed. Rep. of Germany ..... 3627728

[51] Int. Cl.[5] ..... A63F 3/06; A63B 71/06

[52] U.S. Cl. ..... 401/195; 273/143 R

[58] Field of Search ..... 401/52, 195; 446/146; 273/138 R, 138 A, 139, 144 B, 144 R, 143 R

[56] References Cited

U.S. PATENT DOCUMENTS

| | | | |
|---|---|---|---|
| 2,979,602 | 4/1961 | Barnett | 401/195 X |
| 3,963,914 | 6/1976 | Browning et al. | 401/195 X |
| 4,007,364 | 2/1977 | Ojima et al. | 401/195 X |
| 4,188,779 | 2/1980 | Fatton | 273/138 A X |
| 4,541,630 | 9/1985 | Dirks | 401/195 X |
| 4,585,364 | 4/1986 | Liaw | 401/195 |
| 4,768,040 | 8/1988 | Pipkin et al. | 401/195 X |
| 4,801,145 | 1/1989 | Arevalo | 401/195 X |

FOREIGN PATENT DOCUMENTS

| | | | |
|---|---|---|---|
| 8004989 | 5/1980 | Fed. Rep. of Germany . | |
| 8204456 | 3/1984 | Fed. Rep. of Germany . | |
| 571319 | 1/1958 | Italy | 273/143 R |
| 320357 | 5/1957 | Switzerland . | |
| 2106043 | 4/1983 | United Kingdom | 401/195 |
| 2127754 | 4/1984 | United Kingdom . | |

*Primary Examiner*—Richard J. Apley
*Assistant Examiner*—David F. Crosby
*Attorney, Agent, or Firm*—Toren, McGeady & Associates

[57] ABSTRACT

A writing implement in combination with an arrangement for selecting numbers and a visual display for selected numbers, including an electronic random generator having a circuit and display volume adapted to a number of digits, a display arrangement for respectively displaying one number, a battery, and an electrical circuit for electrically connecting the display arrangement through the battery with the random generator.

15 Claims, 1 Drawing Sheet

WRITING INSTRUMENT WITH SYSTEM FOR SELECTING LOTTO NUMBERS

BACKGROUND OF THE INVENTION

The invention is directed to a writing instrument preferably a ball point pen with a selection arrangement for lotto numbers, of the like, and with a visual display for the selected numbers combined therewith.

Such writing implements with a selection arrangement and a visual display for lotto numbers are known.

Thus in the writing implement with a writing cartridge arranged at one end and an added installation (DE-GM No. 8 204 456) arranged at the other end, this added arrangement is designed as a relatively large container, in which a certain number of balls is contained. Between the writing cartridge and the container - and connected with it—there exists a pit which can be viewed from the outside, in which there is room for just a specific number of balls. These very small balls carry the same number executed fourfold diagonally opposite. In this particular embodiment the pit is actually covered by a cylindrical lens, however, in spite of that it is difficult to read since the extraordinary small numbers of the respectively to be read multidigit, for instance six digit number are unlikely to be positioned in the pit below the lens in an easily recognizable manner. It is difficult to toss the balls into the proper position. Additionally these balls are not easy to fabricate. It has to be added that the light conditions for the balls lying in the pit are bad in spite of the cylindrical lens, so that mixups can easily occur for instance between the numbers 3 and 8, 5 and 6 as well as 7 and 1.

An additional disadvantage follows from the unavoidable electrostatic charging of the plastics material balls because of the shaking or tossing which can lead to electrical interference fields which impair the regular entry of the balls into the pits.

Another device with similar drawbacks is a writing implement with a gambling device, consisting of a container with a number of balls which form at least two different groups and with a tube closed at one end and connected to this container into which the balls from the container can enter, in order to form a stack there, wherein the tube is designed and arranged in such a manner that the stack formed by the balls in the tube is visible from outside (CH-PS No. 320 357).

Here the attachment clasp of the writing implement is designed as a tube.

The balls have different colors or they are different in other ways. When using the implement, for instance for football wagers, the balls form three for instance differently colored groups corresponding to (a) won, (b) lost, and (c) draw.

Especially in case of bad lighting conditions it is difficult to differentiate the groups of the small balls from each other which are randomly stacked in the tubularly-shaped attachment clasp. In this case also electrostatic interference fields because of the electrostatic charges occurring when shaking the writing instrument must be added.

A particularity common to the objects of both writing instruments consists in that the read-out of for instance only six magnitudes is possible. If a game of chance requires the evaluation of eleven magnitudes, the known explained writing instruments cannot perform this.

The randomly determined six numbers must be simultaneously read from both writing implements, which complicates the read-out process because of the hard to view extraordinary small adjacent balls.

Another writing instrument which has become known, especially a ball point pen, is equipped with an additional electronics building block, a number display arrangement, a display window located above this, a battery as well as with a contact arrangement operable by push buttons or keys, which are wired in the manner of a pocket calculator and have a row of keys essentially extending in longitudinal direction of the implement. The digital display is arranged behind a display window. In a special embodiment example the parts constituting the pocket calculator are housed in the cap of the writing implement (DE-GM No. 8 004 989).

Generally writing implements with electronic building blocks are actually known (GB-PS No. 2 127 754), however none of these known embodiments is able to determine lotto numbers and to display them individually and consecutively with acceptable readability.

SUMMARY OF THE INVENTION

The present invention is based upon the task of creating a simple writing implement of the type under discussion consisting of few parts, which enables the selection of lotto numbers electronically and arbitrarily.

This task is solved in a simple manner by providing an electronic random generator with a circuit and display volume adapted to the number of lotto digits, and a display arrangement for respectively one number of character which is in circuit connection through a battery as well as electrical circuit switching and connecting elements with the random generator.

This random generator is considerably simpler than a building block designed as an electronic calculator and requires especially only one on/off switch in its current circuit. The electronic building block can be housed without difficulty in the writing implement in addition to the writing cartridge, without rendering the writing implement unwieldy because of this.

The writing implement according to the invention is distinguished by a low number of individual parts which are easily fabricatable and assembleable. Because of the sturdy design of these individual parts a long useful life of the writing implement is assured. It is advantageous that the writing end of the cartridge protruding from the writing part can be secured by the cap, when the cap is placed upon the writing end of the writing part. Because of this the usual mechanism for displacement and return of the writing cartridge relative to the writing part does not need to be installed.

One embodiment example consists of a writing part containing the battery and a cap which can be selectably placed upon one end of this writing part, in which cap the random generator with a display arrangement is located.

It is also advantageous that the current circuit for the random generator is interrupted always if the cap covers the writing ball of the ball point pen. In this way an unnecessary current consumption is prevented.

A particularly simple solution results if the contact pin is at the same time utilized in an on/off switch for the current circuit of the random generator. In this case the cap can be placed in its first position upon the end lying opposite the writing end of the writing implement, in which the contact pin of the random generator does not contact the battery.

The current circuit for the random generator is closed within the cap by a wiring arrangement, which provides a conductive connection between the metal sleeve in the writing portion and a contact spring in the cap.

In another embodiment example a contact part can be utilized for opening and closing the current circuit of the random generator which can be actuated by a push button, which projects from the rear end of the cap and is provided with a stem or handle, which is guided in a longitudinal aperture of an upper end-cap of the cap of the writing implement. By pressing this push button the contact with the end of the random generator is established which lies opposite the contact pin of the battery.

An embodiment example of the invention is explained in the following description, which refers to the drawing.

DETAILED DESCRIPTION OF THE PREFERRED EMBODIMENTS

Figures 1, 2, 3:
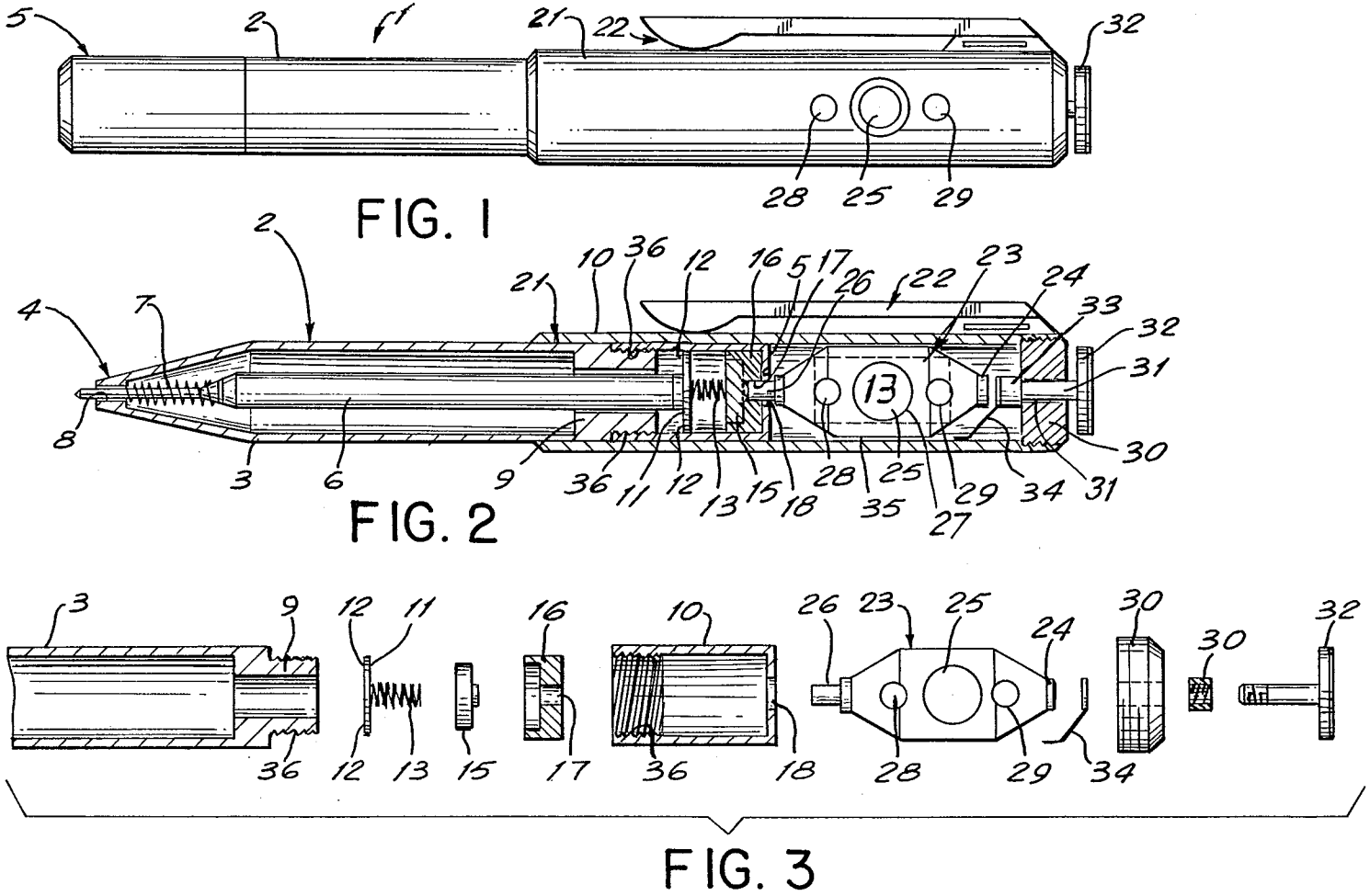
FIG. 1: is a side view of the writing implement in the position of rest.
FIG. 2: a cross-section through the writing implement while being used.
FIG. 3: an exploded illustration of the essential individual parts of the writing implement.

In the side view of the writing implement 1 in FIG. 1 the writing portion 2 is recognizable on the lefthand side and the cap 21 on the righthand side, which cap is placed upon the writing end 4 of the writing implement 1 discernible in FIG. 2. The end 5 of the writing portion 2 lying opposite to the writing end is discernible on the lefthand side in FIG. 1. The cap 21 has a clip known as such and is additionally equipped with lamps 28 and 29 to be explained later as well as a display arrangement 25. A push button 32 is discernible at the righthand end of the cap 21 whose function will be explained later.

FIG. 2 shows a section of the writing implement 1 in the invention in working position. The writing portion 2 is essentially constituted by a housing 3 in which the usual ball point cartridge 6 together with a cartridge spring 7 is arranged which presses the cartridge 6 in FIG. 2 toward the right. The end lying opposite to the writing end of the cartridge 6 is guided in a cartridge guide 9, while the writing end of the cartridge 6 protrudes through an aperture 8 from the writing end 4 of the writing portion 2.

The cartridge guidance 9 has an external non-designated recess which is equipped with a thread 36 upon which the open end of a metallic sleeve 10 can be threaded on. Within the metal sleeve 10 a metal disk 11 can be discerned, which is connected in an electrically conductive manner with the metal sleeve 10 by means of conductor ends 12. The end of the cartridge 6 lying opposite to the writing end rests under the effect of the cartridge spring 7 against the metal disk 11.

The righthand end of the metal sleeve 10 in FIG. 2 represents the end 5 of the writing portion 2 lying opposite to the writing end 4 of the writing portion 2. It has a central bore 18. A plastics material sleeve 16 with a central bore 17 is provided inside the metal sleeve 10 directly next to the end 5 and is arranged concentrically to the bore 18 in the metal sleeve 10. The plastics material sleeve 16 contains a battery 15 which is designed as a button cell. Instead of a battery 15 several batteries 15 can be arranged consecutively if the plastics material sleeve 16 is appropriately designed.

A contact spring 13 is provided at the metal disk 11 which establishes the electrical connection between the metal disk 11 and the battery 15.

A cap 21 depicted also in section is placed upon the end 5 of the writing portion 2 which lies opposite to the writing end 4. The cap contains a random generator 23 with a contact piece 24 as well as a contact pin 26, which protrudes through the bores 17 and 18 of the plastics material sleeve 16 and the metal sleeve 10 and in the depicted state rests at the battery 15.

The random generator 23 is fastened inside the cap 21 in such a way that its contact piece 24 lies opposite the contact piece 33, which is connected to a conductor 35 through a contact pressure spring 34, which conductor establishes the conductive connection to the metal sleeve 10.

The end of the push button 32 rests at the contact piece 33, which push button is guided in a bore 31 of an end cap 30. The contact piece 33 prevents the push button 32 from sliding out of the bore 31. By exerting pressure upon the push button 32 the contact piece 33 seated at the contact spring 34 comes in touch with the contact piece 24 of the random generator 23 so that its current circuit is closed.

The random generator 23 is combined with a display arrangement 25 which is located behind a display window 27. On the right- and lefthand side next to the display device 25 the lamps 28 or 29 are depicted of which one indicates for instance an operational state and the other the current flow.

The essential detail parts of the writing implement are depicted in FIG. 3 in exploded presentation. The outer region of the cartridge guidance 9 is provided with a thread 36 upon which the internal thread of the metal sleeve 10 can be threaded. After unscrewing the metal sleeve 10 from the cartridge casing 3 the cartridge 6 or the battery 15 can be exchanged. By screwing the metal sleeve 10 upon the thread 16 of the cartridge guidance 9, the cartridge 6 is pressed against the cartridge spring 7 and the battery 15 against the contact spring 13. When the cap 21 is placed upon the writing portion 2 there occurs a contact connection between the battery 15 and the contact pin 26 caused by the contact spring 13.

If the cap 21 is placed upon the writing portion 2 in a first position, the writing implement can be used as a simple ball point pen, without that an electrical connection between the battery 15 and the contact pin 26 exists. Only when the cap 21 is pressed further upon the writing portion 2, does the contact between the contact piece 26 and the battery 15 close the current circuit for the random generator 23. In that case the conductor 35 is directly connected to the contact piece 24. This position of the cap upon the writing portion can be immobilized for instance by a slight rise upon the writing portion and a corresponding depression in the cap. By pressing the cap it can reach a second position on the writing portion, in which the contact pin of the random generator rests upon the contact face of the battery.

In the depicted embodiment example on the other hand the establishment of the contact occurs in the previously described manner by pressing the push button 32.

Without affecting the core of the invention the writing implement can also be used as a correspondingly constructed fountain pen or soft point pen. Any artisan will also be able to design a cap 21 for a pencil in such a way that it can enter into effective connection with the random generator 23 in the manner described above.

The random generator 23 is designed in such a way that it passes through a cycle after contact is established and at the end—completely randomly—actuates a number of the display arrangement 25. By renewed pressing of the push button 32 the displayed number is erased and at the same time the random generator 23 is operated, which after the completion of its cycle provides an additional number for display. The random generator 23 is designed in such a way in the invention that it is able to indicate the appropriate number of the lotto digits. The number of the lotto digits varies depending upon the game being played. It is not difficult to lay out the random generator 23 in such a way that it is able to display the number of lotto digits usual in the United States.

Without affecting the core of the invention the random generator 23 can be laid out in such a way, that it selects other digits or characters and displays same such as for instance may be required for games.

The inner circuit technology structure of the random generator is not a subject of the present invention.

What is claimed is:

1. A writing implement in combination with an arrangement for selecting numbers and a visual display for selected numbers, comprising:

electronic random generator means having a circuit and display volume adapted to a number of digits;

display means for respectively displaying one number;

a battery;

a metal disk having a contact spring, the battery being arranged so as to rest against the contact spring;

a writing cartridge having a rear end on which the metal disk is placed, and a front end;

a metal sleeve arranged so as to fix the metal disk and the writing cartridge in a cooperative position; and an electrical circuit means for electrically connecting the display means through the battery with the random generator means.

2. A writing implement according to claim 1, wherein the display means includes a transparent display window and at least one lamp arranged so as to indicate an operational state of the selection arrangement.

3. A writing implement in combination with an arrangement for selecting numbers and a visual display for selected numbers, comprising:

electronic random generator means having a circuit and display volume adapted to a number of digits;

display means for respectively displaying one number;

a battery;

an electrical circuit means for electrically connecting the display means through the battery with the random generator means;

a writing portion having a writing end and an end opposite the writing end, the battery being arranged inside the writing portion; and a cap selectably placeable upon either of the writing end and the opposite end of the writing portion, the random generator means and the display means being arranged in the cap.

4. A writing implement according to claim 3, and further comprising a plastic sleeve and a metal disk having a contact spring, the battery being a button cell which is seated in the plastic sleeve so as to rest against the contact spring, and still further comprising a writing cartridge having a rear end on which the metal disk is placed and a front end, a cartridge spring arranged on the front end of the writing cartridge, and a metal sleeve arranged so as to overlap the plastic sleeve so as to fix the metal disk and writing cartridge in position against the force of the cartridge spring.

5. A writing implement according to claim 4, wherein the random generator means includes a housing having a contact pin which when the cap is placed on the opposite end of the writing portion rests at a contact of the battery by way of bores in the plastic sleeve and the metal sleeve.

6. A writing implement according to claim 5, wherein the contact pin is an on/off switch in a current circuit of the random generator means and is actuatable during placement of the cap upon the opposite end of the writing portion.

7. A writing implement according to claim 4, and further comprising a cartridge guide having a threaded recess, the metal sleeve being screwable upon the threaded recess of the cartridge guide.

8. A writing implement according to claim 4, and further comprising a contact pressure spring provided within the cap and at least one conductor arranged so as to electrically connect the metal sleeve with the contact pressure spring.

9. A writing implement according to claim 3, and further comprising a manually actuatable on/off switch arranged in the cap in the current circuit of the random generator means.

10. A writing implement according to claim 9, wherein the manually operable on/off switch includes a pushbutton displaceable in a bore of an end cap of the cap.

11. A writing implement in combination with an arrangement for selecting numbers and a visual display for selected numbers, comprising:

electronic random generator means having a circuit and display volume adapted to a number of digits;

display means for respectively displaying one number;

a battery;

an electrical circuit means for electrically connecting the display means through the battery with the random generator means; and a plastic sleeve and a metal disk having a contact spring, the battery being a button cell which is seated in the plastic sleeve so as to rest against the contact spring, and still further comprising a writing cartridge having a rear end on which the metal disk is placed and a front end, a cartridge spring being arranged on the front end of the writing cartridge, and a metal sleeve arranged so as to overlap the plastic sleeve so as to fix the metal disk and writing cartridge in position against the force of the cartridge spring.

12. A writing implement according to claim 11, wherein the random generator means includes a housing having a contact pin which when the cap is placed on the opposite end of the writing portion rests at a contact of the battery by way of bores in the plastic sleeve and the metal sleeve.

13. A writing implement according to claim 12, wherein the contact pin is an on/off switch in a current circuit of the random generator means and is actuatable during placement of the cap upon the opposite end of the writing portion.

14. A writing implement according to claim 11, and further comprising a cartridge guide having a threaded recess, the metal sleeve being screwable upon the threaded recess of the cartridge guide.

15. A writing implement according to claim 11, and further comprising a contact pressure spring provided within the cap and at least one conductor arranged so as to electrically connect the metal sleeve with the contact pressure spring.

* * * * *